United States Patent [19]

Kachadourian

[11] 4,378,007

[45] Mar. 29, 1983

[54] MASSAGING DEVICE

[76] Inventor: Garo Kachadourian, 745 Place Fortier, Apt. 711, Ville St. Laurent, Quebec, Canada

[21] Appl. No.: 267,543

[22] Filed: May 27, 1981

[30] Foreign Application Priority Data

Aug. 19, 1980 [CA] Canada ..... 358609

[51] Int. Cl.[3] ..... A61H 15/00

[52] U.S. Cl. ..... 128/57; 272/96; D24/36

[58] Field of Search ..... 272/96; 128/25 B, 57, 128/56, 60; D24/36

[56] References Cited

U.S. PATENT DOCUMENTS

| | | | |
|---|---|---|---|
| D. 119,035 | 2/1940 | Lindgren | 128/25 B |
| D. 152,951 | 3/1949 | Eldredge | 128/25 B |
| 444,597 | 1/1891 | Lichtenstadt | 128/57 X |
| 1,481,038 | 1/1924 | Stephenson | 128/25 B |
| 1,886,544 | 11/1932 | Hemp | 128/57 X |
| 2,448,797 | 9/1948 | Gustlin | 272/96 |
| 3,037,500 | 6/1962 | Daugherty | 272/96 X |
| 3,662,748 | 5/1972 | Thurman | 128/25 B |
| 4,109,649 | 8/1978 | Iyomasa | 128/25 B |
| 4,142,519 | 3/1979 | Ferguson | 128/25 B |

FOREIGN PATENT DOCUMENTS

| | | | |
|---|---|---|---|
| 544041 | 6/1922 | France | 128/60 |
| 56549 | 5/1944 | Netherlands | 272/96 |

*Primary Examiner*—Richard J. Johnson

*Attorney, Agent, or Firm*—Alan Swabey; Robert Mitchell; Guy Houle

[57] ABSTRACT

An integral elongated symmetrical roller of overall circular cross-section throughout made up of a pair of spaced apart annular traction rings intervened by inwardly tapering studded base surfaces of lesser diameter each meeting a central annular studded ridge. The ends of the roller may be provided with a bed of studs.

6 Claims, 5 Drawing Figures

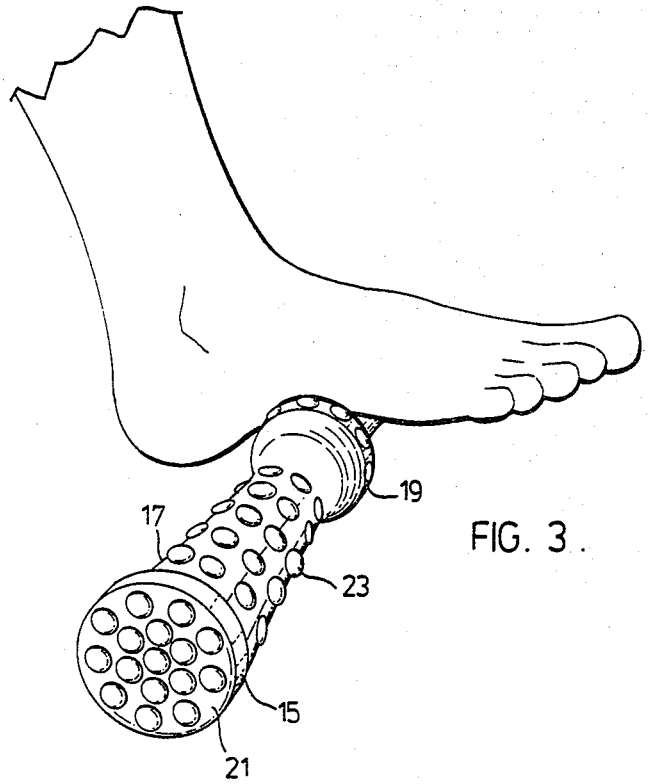
FIG. 3.
FIG. 2.
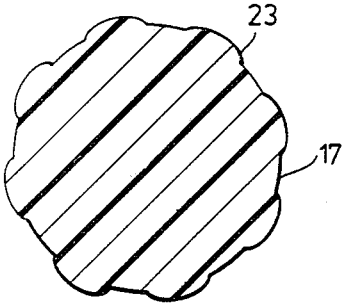
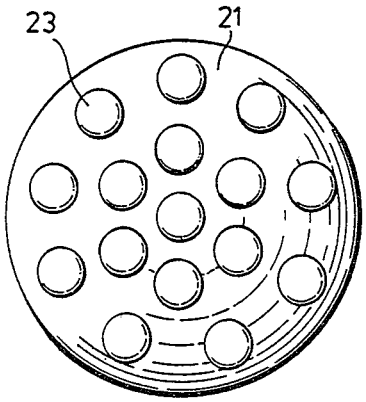
FIG. 4.

MASSAGING DEVICE

BACKGROUND OF THE INVENTION

1. Field of the Invention

This invention relates to a device for massaging parts of the body, especially the feet.

2. Description of the Prior Art

A particular aim of the invention is to provide for scientific massage generally of the type described in "Stories the Feet Have Told Thru Reflexology" by Ingham, published by Ingham Publishing Incorporated, 1951, and revised in 1963. This text describes "zone therapy" and a system of massage in which kneading thumb and finger pressure is applied to local zones of the feet to achieve certain therapeutic effects. An aim of the invention is to provide means for effecting this type of massage mechanically.

SUMMARY OF THE INVENTION

With this in mind, the invention is embodied in an elongated symmetrical roller of overall circular cross-section made up of a pair of spaced apart annular traction rings intervened by inwardly tapering studded lateral base surfaces of less diameter than the rings intervened by a central annular studded ridge of lesser overall diameter than that of the rings. The studs are rounded and of a size and spaced in such a way as to form a bed of studs which support the feet away from the base surface.

Preferably, at least one end of the roller (preferably both ends) is provided with a rounded studded surface.

The body of the roller may be of wood, metal, plastic or other solid material, with preferred results obtained with an integral body of natural rubber having a hardness of from 27 to 53 Dura, which tends to reproduce more closely the action of kneading with a human thumb or finger.

The roller is used for treating the feet, in a primary treatment by placing it on the floor and first rolling each foot in turn over the bed of studs preferably with the outside of the foot closest to the central ridge. When massage has been effected in this way, a more strenuous massaging effect can be had, in a secondary treatment, by rolling the foot back and forth over the central ridge, working in several strokes from one side of the foot to the other. The device is used for treating other parts of the body by pressing the studded ends against the body with a punching action so that the bed of studs is brought into contact with and exerts a stimulating effect on specific zones to improve the circulation. Preferably, the studs on the ends of the body have a softer consistency than the body, for example, of natural rubber of 25 to 30 Dura.

The action of the bed of studs is to give overall support to the foot while each individual stud exerts pressure similar to thumb or finger pressure, with a kneading action against the flesh of the foot, penetrating the structure beneath. The central ridge acts to penetrate more deeply than the studs on the lateral surfaces. The action of the ends of the device when punched against other parts of the body is similar.

BRIEF DESCRIPTION OF THE DRAWINGS

Having thus generally described the invention, it will be referred to in more detail by reference to the accompanying drawings which illustrate a preferred embodiment and in which:

FIG. 2 is a cross-section as along the lines 2—2 of FIG. 1;

FIG. 3 is an illustration of the use of the roller in massaging the foot;

FIG. 4 is an end elevation of the roller shown in FIGS. 1 to 3;

DESCRIPTION OF THE PREFERRED EMBODIMENTS

Figure 1:
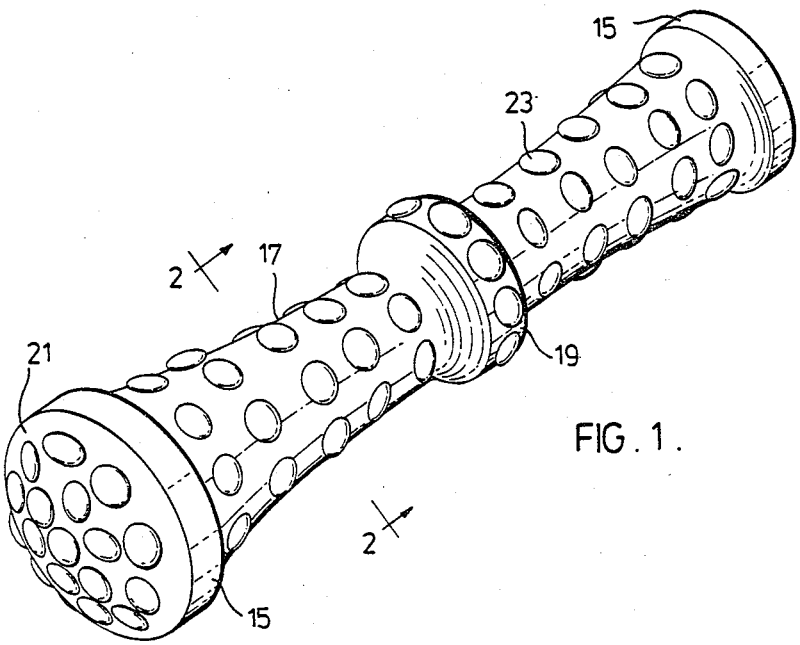
FIG. 1 is a perspective view of a preferred form of roller according to the invention.
Figure 5:
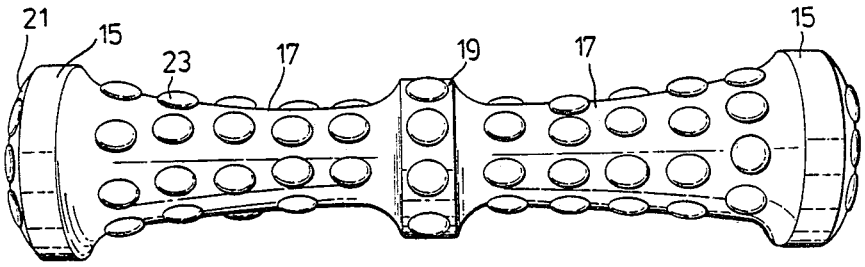
FIG. 5 (appearing on the same sheet as FIG. 1) is a side elevation of the roller shown in FIG. 1.

Referring more particularly to the drawings, the roller shown has an elongated integral body provided near each end annular traction rings 15 on which the roller may be rolled evenly back and forth along the floor under pressure. Extending inwardly from each ring 15 is a circular cross-section tapering studded base surface 17 providing a bed of studs which extends from the wheel 15 to a central annular studded ridge 19. The studs are arranged laterally in circumferential rows in which the individual studs are substantially uniformly spaced apart. The base surface 17 narrows in cross-sectional diameter from a maximum adjacent to the wheel 15 to a minimum close to the ridge 19.

Each end of the roller is provided with a rounded studded surface 21.

Protruding from the treating surfaces 17, 19 and 21, are truncated spherical studs whose dimensions and distribution, as described elsewhere, are essential to the production of the proper massaging effect.

To effect treatment of the foot, the roller is placed on the floor or other platform and the foot is pressed, in a primary treatment against the bed of studs on a lateral base surface and rolled back and forth over the bed, which acts on specific areas of the foot in much the same way as the thumb or finger does in manual massage. Preferably the inside of the foot is placed towards the outside of the roller. With the roller on the floor, the foot is first rolled back and forth over the tapering surfaces 17. This provides massaging kneading pressure by each of the studs with which the foot comes into contact, whose intensity is varied according to the pressure exerted. Then, in order to achieve deeper penetration, the foot may be rolled over the central studded ridge 19, in a secondary treatment, working from one side of the foot to the other.

The roller is used on the body by taking it in the hand and punching an end against the surface of the body so that the studs exert massaging pressure. A kneading action is effected as described in the Ingham text and referred to by specialists in this field as "acu-press" or "punch-puncture".

The studs should cover a major portion of the treating surfaces so that, practically speaking, the foot beds down on the studs as it is rolled and pressed against them. While the dimensions may vary, one preferred device has a body, as shown in the drawings, of the following dimensions: length of the roller 10 inches; diameter of the traction rings 2.5 inches; maximum diameter of the lateral base treating surface 1.7 inches; minimum diameter of the lateral base treating surface 1.1 inch; diameter of the central ridge 1.7 inches. Effective results may be achieved with devices in which the dimensions vary plus or minus one third from the preferred dimensions given.

The studs are rounded, preferably semi-spherical.

The preferred maximum lateral dimension (width) of a stud is about one centimeter and a preferred height about three millimeters. Effective results may be achieved with the studs varying from these dimensions plus or minus one third. Preferably, the studs should be spaced from each other in the axial and circumferential direction not more than the width of a stud and not less than half the width of a stud so as to form a foot supportive bed with the parts of the foot between the studs essentially straddling the spaces between them, as opposed to receiving support by the base surface, even though the loose flesh of the foot may touch the base surface. Likewise, the array of studs on the central ridge beds down the foot so that the parts of the foot between the studs essentially straddle the spaces between them, as opposed to being supported by the base surface of the ridge.

I claim:

1. A device for treating the foot and body, comprising, an integral elongated symmetrical roller of overall circular cross-section throughout made up of a pair of spaced apart annular traction rings intervened by inwardly tapering studded base surfaces of lesser diameter, each base surface extending inwardly from one of the traction rings to an abrupt meeting with a central annular studded ridge, having a diameter less than that of a traction ring, the studded base surfaces being provided with uniform rounded studs of such dimensions and spaced apart effectively to form a primary treatment bed which supports a foot pressed against it from bearing against the base surface while each stud penetrates the flesh to exert kneading pressure on a specific area of the foot, the studs on the base surfaces being arranged laterally in circumferential spaced apart rows in which the individual studs are substantially uniformly spaced apart not more than the width of a stud nor less than half the width of a stud and adjacent studs of respective rows are spaced apart in the axial direction of the roller not more than the width of a stud nor less than half the width of a stud, the studs on the ridge being uniform and in a single row and substantially uniformly spaced apart whereby the ridge presents a relatively narrow secondary treatment bed for bedding down the foot for deeper penetration.

2. A device, as defined in claim 1, in which the studs are rounded and have a lateral dimension of one centimeter plus or minus one third and a height of three millimeters plus or minus one third.

3. A device, as defined in claim 1, in which the roller is an integral body made of natural rubber having a hardness of 27 to 53 Dura.

4. A device, as defined in claim 1, which has rounded studded ends.

5. A device, as defined in claim 4, in which the rounded studded ends are of natural rubber softer than the rubber of the tapering surfaces and ridge.

6. A device, as defined in claim 5, in which the studs on the ends of the body are of natural rubber having a consistency of 25 to 30 Dura.

* * * * *